US007226285B2

(12) United States Patent
Tsai

(10) Patent No.: US 7,226,285 B2
(45) Date of Patent: Jun. 5, 2007

(54) GAS FLOWRATE CONTROL DEVICE FOR GAS BURNER

(76) Inventor: Chin-Lin Tsai, No. 94, Sec f, Chung Hsin Rd., San Chung City, Taipei Hsien (TW)

( * ) Notice: Subject to any disclaimer, the term of this patent is extended or adjusted under 35 U.S.C. 154(b) by 279 days.

(21) Appl. No.: 11/041,961

(22) Filed: Jan. 26, 2005

(65) Prior Publication Data

US 2006/0166155 A1 Jul. 27, 2006

(51) Int. Cl.
*F23D 11/36* (2006.01)
*F23Q 2/08* (2006.01)
*F16K 51/00* (2006.01)

(52) U.S. Cl. ..... 431/153; 431/254; 431/277; 431/130; 431/131; 126/413; 126/238; 251/286

(58) Field of Classification Search ..... 431/153, 431/254, 277, 130, 131, 140, 150; 126/413, 126/414, 238, 236; 251/286, 287
See application file for complete search history.

(56) References Cited

U.S. PATENT DOCUMENTS

| | | | | |
|---|---|---|---|---|
| 4,097,222 | A * | 6/1978 | Faudemay | 431/344 |
| 4,552,124 | A * | 11/1985 | Nakajima | 126/413 |
| 5,020,990 | A * | 6/1991 | Chen | 431/274 |
| 6,123,541 | A * | 9/2000 | Yang | 431/153 |
| 2005/0202359 | A1 * | 9/2005 | Lin et al. | 431/153 |

* cited by examiner

*Primary Examiner*—Alfred Basichas
(74) *Attorney, Agent, or Firm*—Troxell Law Office, PLLC

(57) ABSTRACT

A gas flowrate control device for turning the flame adjustment wheel of a gas burner is disclosed to include a control wheel, which has an internal gear meshed with the flame adjustment wheel of the gas burner, a big gear surrounding the internal gear, and two small gears respectively formed integral with two sides of the big gear and surrounding the internal gear, and a handle, which has a grip and two arched clamping arms symmetrically extending from the grip and clamped on the control wheel, each arched clamping arm having two toothed arm positions respectively meshed with the two small gears of the control wheel and a crevice defined between the two arm portions for accommodating the big gear.

4 Claims, 4 Drawing Sheets

GAS FLOWRATE CONTROL DEVICE FOR GAS BURNER

BACKGROUND OF THE INVENTION

1. Field of the Invention

The present invention relates to a gas burner and more specifically, to the gas flowrate control device for use in a gas burner for controlling the output flowrate of gas.

2. Description of the Related Art

Gas burners are commonly used in gas ranges, gas lighters, and etc. For regulating the output of gas, a gas lighter is equipped with a gas flowrate control device (flame adjustment wheel).

FIG. 1 is an exploded view of a conventional gas lighter. As illustrated, the gas lighter comprises a gas nozzle A for output of gas, a gas valve B for controlling output of gas to the gas nozzle A, and a gas lever D for controlling the operation of the gas valve B. The gas lever D has a toothed portion E meshed with the flame adjustment wheel C of the gas valve B. According to this design, the gas lever D is movable between two opposite upright top walls F, i.e., the gas flowrate adjustment range is limited to the angle between the two opposite upright top walls F. This adjustment range cannot satisfy the user's demand. When adjusted to the maximum status, the flame may be still too weak to satisfy the user's demand. When adjusted to the smallest status, the flame may be still tool strong to meet the user's requirement. Most people who ever used disposable gas lighters have experienced this inconvenience.

In order to solve the aforesaid problem, the gas valve B must be reset. However, it is necessary to dismount the gas lever D and then to mount the gas lever D again adjust adjustment of the gas valve B. This procedure requires a special technique. Most consumers cannot make this adjustment, and may throw the gas lighter away.

Taiwan Patent Publication No. 498,966, entitled "Gas Burner Flowrate Adjustment Structure), teaches the use of an added regulator, which is comprised of a wheel and a regulating component. The regulating component has a coupling hole. The wheel has an annular coupling portion coupled to the coupling hole of the regulating component. The use of the regulator allows a wide flowrate adjustment range. However, the coupling structure between the wheel and the regulating component requires a high precision, thereby complicating the processing.

SUMMARY OF THE INVENTION

The present invention has been accomplished under the circumstances in view. It is the main object of the present invention to provide a. gas flowrate control device, which allows adjustment of the gas flowrate adjustment range. It is another object of the present invention to provide a gas flowrate control device, which is easy to adjust. To achieve these and other objects of the present invention, the gas flowrate control device is used in a gas burner for turning a flame adjustment wheel of said gas burner to control the output of gas, comprising: a control wheel and a handle. The control wheel comprises an internal gear meshed with the flame adjustment wheel of the gas burner, a big gear surrounding the internal gear, and two small gears respectively formed integral with two sides of the big gear and surrounding the internal gear. The handle comprises a grip and two arched clamping arms symmetrically extending from the grip and clamped on the control wheel. Each arched clamping arm comprises an upper arm portion, a lower arm portion, and a crevice defined between the upper arm portion and the lower arm portion for accommodating the big gear. The upper arm portion and the lower arm portion each have a series of teeth for engaging the small gears and a thickness corresponding to the height of each small gear.

DETAILED DESCRIPTION OF THE PREFERRED EMBODIMENT

Figure 1:
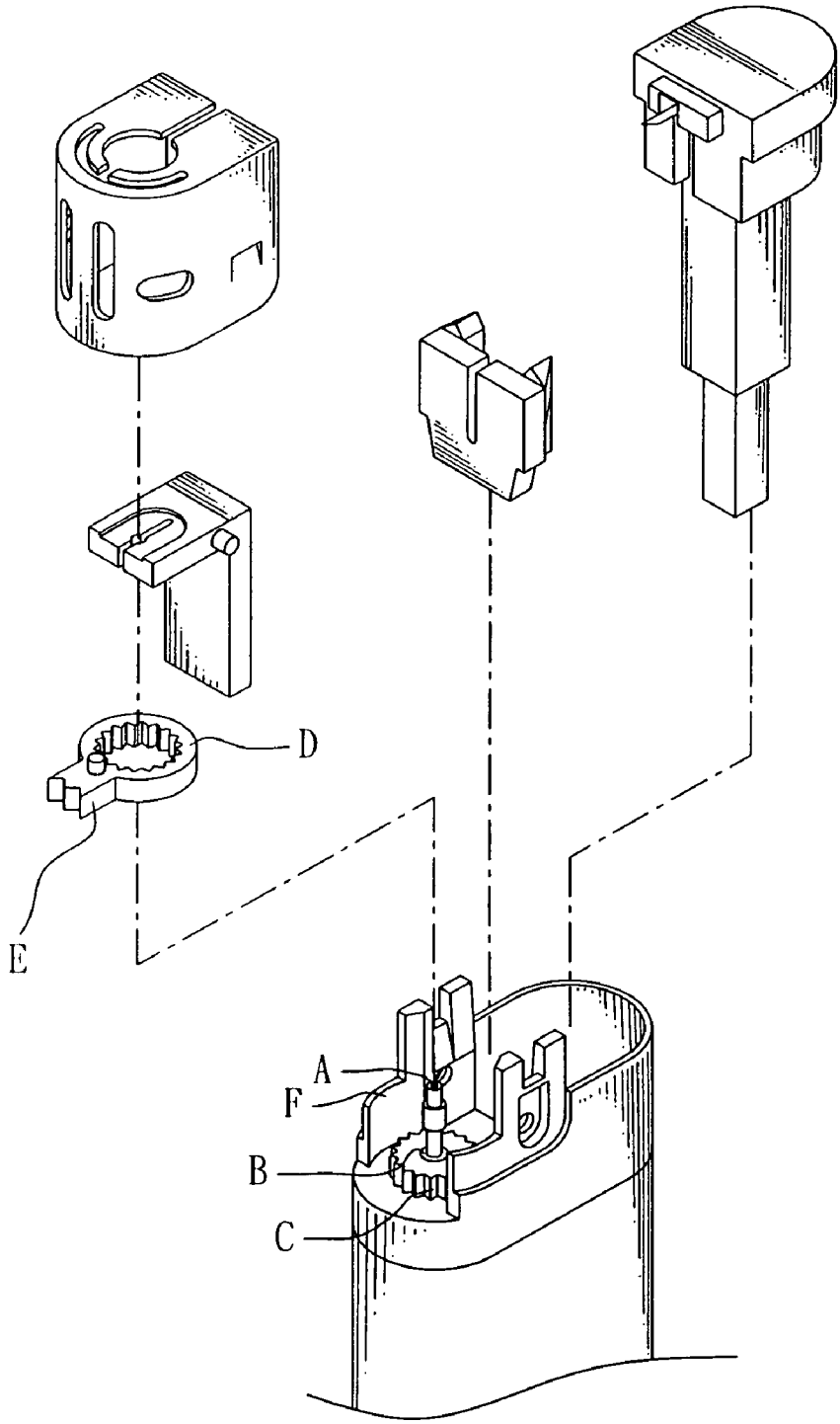
(PRIOR ART) FIG. 1
FIG. 1 is an exploded view of a conventional gas lighter.
Figure 2:
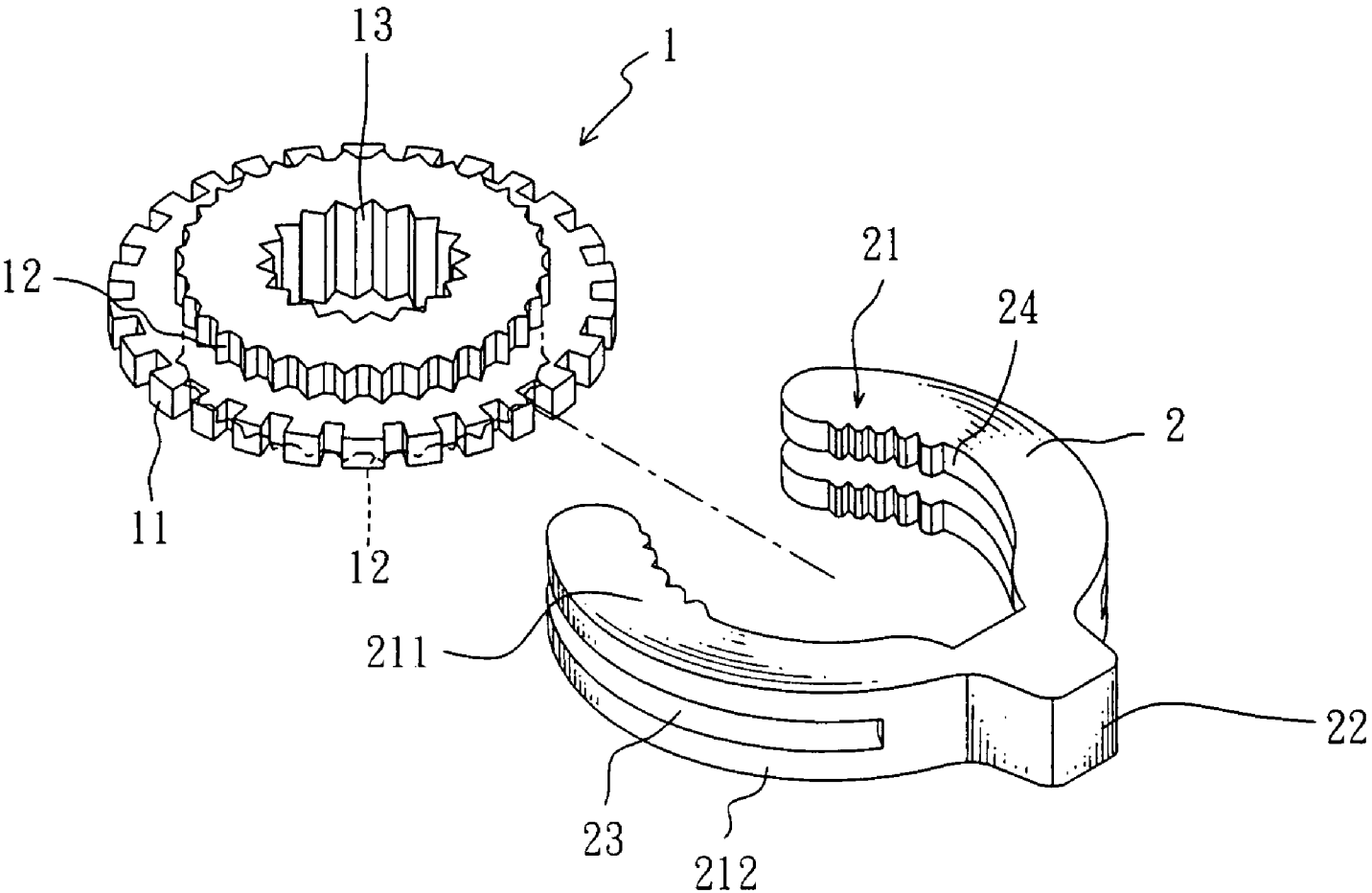
FIG. 2 is a schematic drawing of a gas flowrate control device according to the present invention.

Referring to FIG. 2, a gas flowrate control device in accordance with the present invention is shown comprised of a control wheel 1 and a handle 2.

The control wheel 1 comprises an internal gear 13, a big gear 11 surrounding the internal gear 13, and two small gears 12 respectively formed integral with the two sides of the big gear 11 and surrounding the internal gear 13.

The handle 2 comprises a grip 22 and two arched clamping arms 21 symmetrically extending from the grip 22. Each arched clamping arm 21 comprises an upper arm portion 211, a lower arm portion 212, and a crevice 23 defined between the upper arm portion 211 and the lower arm portion 212. The upper arm portion 211 and the lower arm portion 212 have an equal thickness corresponding to the height of the small gears 12. Further, the upper arm portion 211 and the lower arm portion 212 each have teeth 24 provided in the end portion for engaging the small gears 12. The height of the crevice 23 is approximately equal to the height of the big gear 11.

Figure 3:
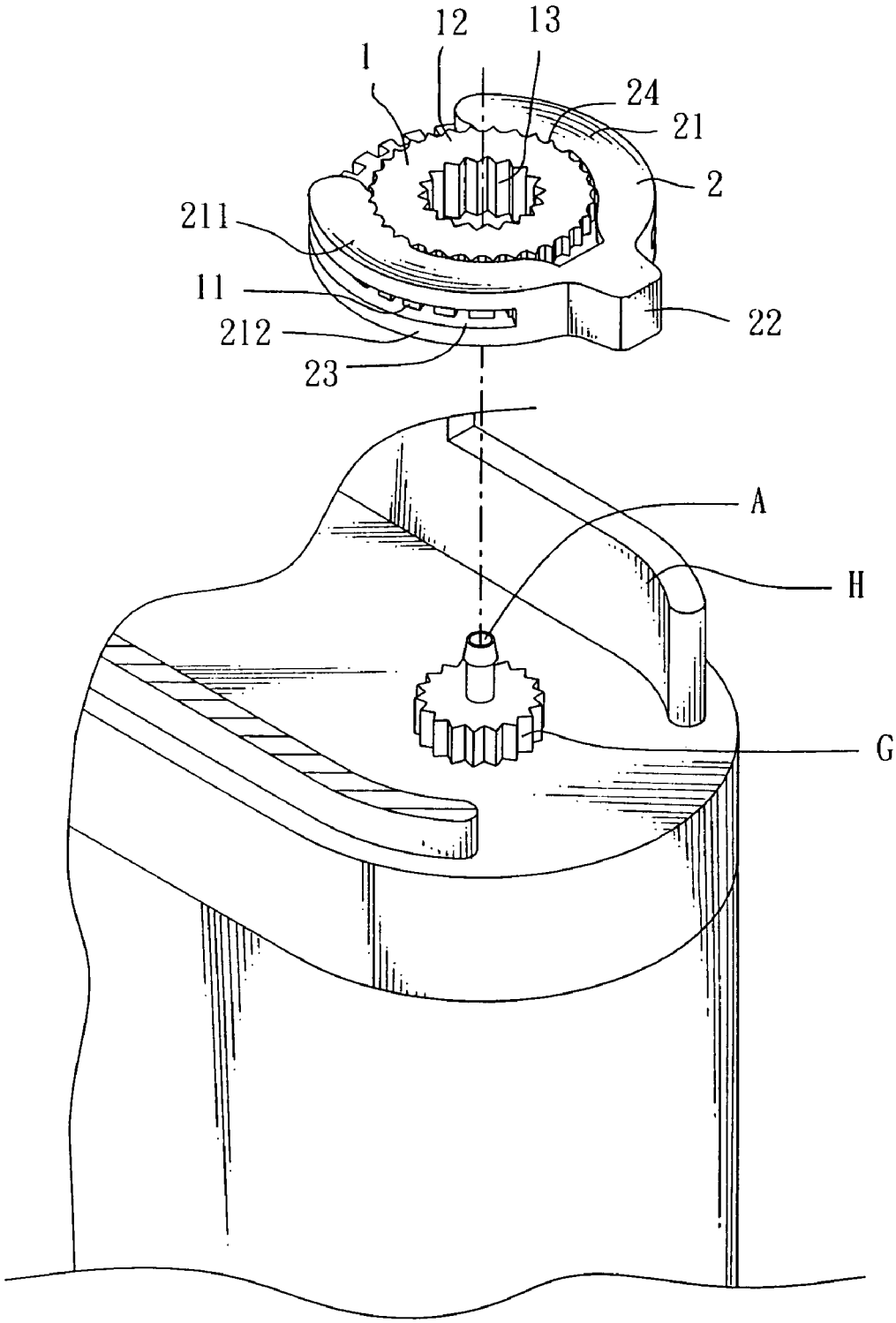
FIG. 3 is a schematic drawing showing the use of the present invention in a gas lighter.

Referring to FIG. 3, the control wheel 1 is inserted with the big gear 11 thereof into the crevices 23 of the two arched clamping arms 21 of the handle 2 to force the small gears 12 into engagement with the teeth 24 of the arched clamping arms 21, and then the internal gear 13 of the control wheel 1 is coupled to the flame adjustment wheel G of the gas lighter between the two opposite upright top walls H. After installation, the user can hold and press the grip 22 with the fingers to make the opening between two arched clamping arm 21 spreads slightly and move the handle 2 to rotate the flame adjustment wheel G, and therefore the gas flowrate outputted through the gas nozzle A is relatively adjusted.

If the user wishes to adjust the adjustment range of the flame adjustment wheel G of the gas lighter, holds the grip 22 with the fingers and then push the handle 2 against the control wheel 1 to change the relative position between the handle 2 and the flame adjustment wheel G.

Figure 4:
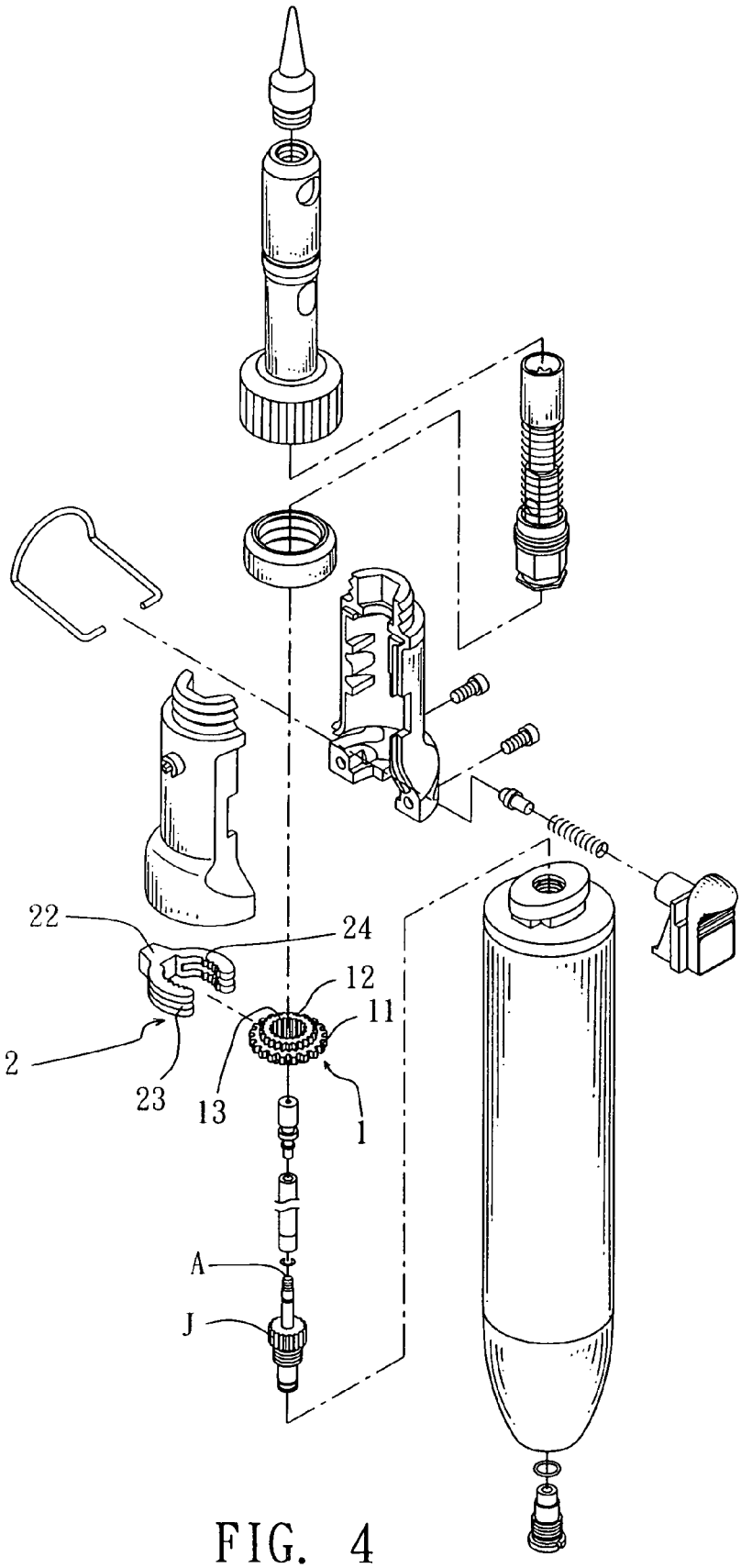
FIG. 4 is a schematic exploded view showing the use of the present invention in a gas iron.

FIG. 4 shows another application example of the present invention. According to this application example, the gas flowrate control device is used in a gas iron and adapted to move the flame adjustment wheel J of the gas iron.

Although a particular embodiment of the invention has been described in detail for purposes of illustration, various modifications and enhancements may be made without departing from the spirit and scope of the invention.

What the invention claimed is:

1. A gas flowrate control device used in a gas burner for turning a flame adjustment wheel of said gas burner to control the output of gas, the gas flowrate control device comprising:

a control wheel, said control wheel comprising an internal gear meshed with said flame adjustment wheel of said gas burner, a big gear surrounding said internal gear, and two small gears respectively formed integral with two sides of said big gear and surrounding said internal gear; and a handle, said handle comprising a grip and two arched clamping arms symmetrically extending from said grip and clamped on said control wheel, each said arched clamping arm comprising an upper arm portion, a lower arm portion, and a crevice defined between said upper arm portion and said lower arm portion for accommodating said big gear, said upper arm portion and said lower arm portion each having a series of teeth for engaging said small gears and a thickness corresponding to the height of each said small gear.

2. The gas flowrate control device as claimed in claim 1, wherein the gas burner is a gas lighter.

3. The gas flowrate control device as claimed in claim 1, wherein said gas burner is used in a gas iron.

4. The gas flowrate control device as claimed in claim 1, wherein said teeth provided in the end portions of arched clamping arm for engaging the small gears.

* * * * *